US008969244B2

(12) United States Patent
Dontula et al.

(10) Patent No.: US 8,969,244 B2
(45) Date of Patent: Mar. 3, 2015

(54) METALLIZED THERMAL DYE IMAGE RECEIVER ELEMENTS AND IMAGING

(75) Inventors: Narasimharao Dontula, Rochester, NY (US); Somsack Chang, Riverview, FL (US); James S. Honan, Spencerport, NY (US)

(73) Assignee: Kodak Alaris Inc., Rochester, NY (US)

( * ) Notice: Subject to any disclaimer, the term of this patent is extended or adjusted under 35 U.S.C. 154(b) by 3 days.

(21) Appl. No.: 13/612,920

(22) Filed: Sep. 13, 2012

(65) Prior Publication Data

US 2014/0071218 A1 Mar. 13, 2014

(51) Int. Cl.
*B41M 5/50* (2006.01)
*B41M 5/52* (2006.01)

(52) U.S. Cl.
CPC ..... *B41M 5/508* (2013.01); *B41M 5/5218* (2013.01)
USPC ..... 503/227

(58) Field of Classification Search
CPC ..... B41M 5/506; B41M 5/5218; B41M 2205/02; B41M 5/502; B41M 5/508
USPC ..... 503/227, 22
See application file for complete search history.

(56) References Cited

U.S. PATENT DOCUMENTS

| | | | | |
|---|---|---|---|---|
| 5,395,719 | A | 3/1995 | Jongewaard et al. | |
| 5,464,723 | A | 11/1995 | Chou | |
| 5,643,659 | A | 7/1997 | Kobayashi et al. | |
| 5,698,368 | A | 12/1997 | Obata et al. | |
| 5,932,325 | A | 8/1999 | Ebihara et al. | |
| 6,165,611 | A | 12/2000 | Hirano et al. | |
| 6,291,150 | B1 | 9/2001 | Camp et al. | |
| 6,458,743 | B1 | 10/2002 | Menin | |
| 6,562,442 | B2 | 5/2003 | Sogabe et al. | |
| 6,703,088 | B2 | 3/2004 | Hayashi et al. | |
| 7,094,733 | B2 * | 8/2006 | Laney et al. | 503/227 |
| 7,479,470 | B2 | 1/2009 | Hiroishi et al. | |
| 7,521,102 | B2 | 4/2009 | Morizumi et al. | |
| 7,582,403 | B2 | 9/2009 | Bailey et al. | |
| 8,222,186 | B2 | 7/2012 | Majumdar et al. | |
| 2008/0220190 | A1 | 9/2008 | Majumdar et al. | |
| 2010/0327480 | A1 | 12/2010 | Dontula et al. | |
| 2010/0330306 | A1 | 12/2010 | Dontula et al. | |
| 2011/0091667 | A1 | 4/2011 | Majumdar et al. | |

FOREIGN PATENT DOCUMENTS

| | | |
|---|---|---|
| JP | 2005-096357 | 4/2005 |
| JP | 2009-154399 | 7/2009 |

* cited by examiner

*Primary Examiner* — Bruce H Hess
(74) *Attorney, Agent, or Firm* — Hogan Lovells US LLP

(57) ABSTRACT

A thermal dye image receiver element has a substrate comprising a voided compliant layer and metalized layer. Disposed on the metalized layer is an opacifying layer that includes an opacifying agent and a dye receiving layer. This thermal dye image receiver element can be a duplex element with image receiving layers on both sides of the substrate, and it can be used in association with a thermal donor element to provide a thermal image on either or opposing sides of the receiver element. The metalized layer provides increased specular reflectance under resulting thermal dye images.

19 Claims, No Drawings

METALLIZED THERMAL DYE IMAGE RECEIVER ELEMENTS AND IMAGING

FIELD OF THE INVENTION

This invention relates to thermal dye image receiver elements that have metalized layers to provide enhanced thermal dye images. This invention also relates to thermal imaging assemblies and methods for providing thermal transfer of dyes or clear films.

BACKGROUND OF THE INVENTION

In recent years, thermal transfer systems have been developed to obtain prints from pictures that have been generated from a camera or scanning device. According to one way of obtaining such prints, an electronic picture is first subjected to color separation by color filters. The respective color-separated images are then converted into electrical signals. These signals are then transmitted to a thermal printer. To obtain the print, a cyan, magenta or yellow dye-donor element is placed face-to-face with a dye receiver element. The two are then inserted between a thermal printing head and a platen roller. A line-type thermal printing head is used to apply heat from the back of the dye-donor sheet. The thermal printing head has many heating elements and is heated up sequentially in response to one of the cyan, magenta or yellow signals. The process is then repeated for the other colors. A color hard copy is thus obtained which corresponds to the original picture viewed on a screen.

Dye receiver elements used in thermal dye transfer generally include a support (transparent or reflective) bearing on one side thereof a dye image-receiving layer, and optionally additional layers, such as a compliant or cushioning layer between the support and the dye receiving layer. The compliant layer provides insulation to keep heat generated by the thermal head at the surface of the print, and also provides close contact between the donor ribbon and receiving sheet which is essential for uniform print quality.

U.S. Patent Application Publications 2010/0327480 and 2010/0330306 (both Dontula et al.) describe imaging elements having multiple extruded layers included extruded compliant and antistatic subbing layers. U.S. Patent Application Publication 2008/0220190 (Majumdar et al.) describes image recording elements comprising a support having thereon an aqueous subbing layer and an extruded dye receiving layer.

U.S. Patent Application Publication 2011/0091667 (Majumdar et al.) describes thermal dye transfer receiver elements that include an extruded compliant layer and an antistatic layer adhering it to an image receiving layer.

As the popularity of multicolor thermal dye images has increased, there has been an interest in providing images with increased specular reflectance or to provide a metallic luster or brightness to enhance color, design, or decoration.

U.S. Pat. No. 6,291,150 (Camp et al.) describes reflective photographic materials having metallic layers below the photographic imaging layers to give the image "depth" or to make it appear to have three dimensions.

U.S. Pat. No. 5,395,719 (Jongewaard et al.) describes thermal transfer receptor element having a vapor deposited metal layer, non-opacifying primer layer, and a thermal dye receiving layer. Moreover, U.S. Pat. No. 7,479,470 (Hiroishi et al.) describes a thermal transfer receiver having a metal layer disposed between the support and an underlayer that may include a pigment such as titanium oxide or barium sulfate.

JP Patent Application Publication 2009-154399 (Oji Paper Co. Ltd.) describes a heat transfer receiving sheet having an intermediate layer and a metal-deposited layer between the intermediate layer and an image receptor layer.

However, if the thickness of the metallic layer is too great, a printed image has reduced sharpness and lowered density. Thus, despite the various embodiments known in the art, there is a need to improve thermal dye image receiver elements that have metallic layers so that reflectance is improved without loss of other image properties. It is also desired to provide such images on both sides of a duplex receiver element.

SUMMARY OF THE INVENTION

The present invention provides a thermal dye image receiver element comprising, in order:

A) a substrate comprising, in order:
a voided compliant layer, and
a metalized layer,
B) an opacifying layer, and
C) a dye receiving layer, wherein the opacifying layer comprises an opacifying agent in an amount sufficient to provide the thermal dye image receiver element with a reflectance of at least 10% and up to and including 50%.

In some embodiments of the thermal dye image receiver element of this invention, the substrate comprises, in order:
a support base,
a voided compliant layer, and
a metalized layer.

In addition, in some embodiments of this invention, the thermal dye image receiver element is a duplex thermal dye image receiver element, comprising, in order: a support base, a voided compliant layer, a metalized layer, an opacifying layer, and a dye receiving layer, and comprising on the opposing side of the support base, in order, the same or different compliant layer, and the same or different dye receiving layer.

For example, in some embodiments of this invention, the thermal dye image receiver element comprises:

A) a substrate that comprises, in order:
a raw paper support base,
an adhesive layer,
a voided compliant layer,
a polymeric skin layer directly adjacent at least one side of the compliant layer, the polymeric skin layer optionally comprising titanium dioxide, and
an aluminum layer having a dry thickness of at least 300 Å and up to and including 600 Å,
B) an opacifying layer that comprises one or more opacifying agents that includes titanium dioxide in a total amount of at least 5 mg/m$^2$ and up to and including 20 mg/m$^2$, to provide a reflectance of at least 25% and up to and including 45%.

Such thermal dye image receiver elements can also be duplex elements comprising the same layer arrangement and composition on both sides of the raw paper support base.

In many one-side printable thermal dye image receiver elements, an adhesive tie layer is disposed between the raw paper support base and the voided compliant layer.

This invention also provides an assembly comprising any embodiment of the thermal dye image transfer receiver element of this invention that is arranged in thermal association with a thermal donor element.

Moreover, this invention provides a method comprising thermally imaging the thermal dye image receiver element of any embodiment of this invention, in thermal association with a thermal donor element to provide a thermal dye image, a protective laminate, or both, in the thermal dye image receiver element.

For example, in some embodiments of this method, the thermal dye image receiver element is a duplex element, and the method comprises imaging both sides of the thermal dye image receiver element using the same or different thermal donor element, to provide a thermal dye image, a protective laminate, or both, independently on both sides of the thermal dye image receiver element.

In other embodiments of this invention:

A) the substrate comprises, in order:

a raw paper support base, a voided compliant layer, a polymeric skin layer directly adjacent at least one side of the compliant layer, the polymeric skin layer optionally comprising titanium dioxide, and an aluminum layer having a dry thickness of at least 300 Å and up to and including 600 Å, B) the opacifying layer comprises one or more opacifying agents that includes titanium dioxide in a total amount of at least 5 $mg/m^2$ and up to and including 20 $mg/m^2$, to provide a reflectance of at least 25% and up to and including 45%.

The present invention provides a thermal dye image receiver element that exhibits improved specular reflectance without loss of other image properties in thermally transferred thermal images. An opacifying layer is disposed between the metalized layer and the dye receiving layer to further enhance the specular reflectance provided by the metalized layer. In addition, the present invention can provide a difference in reflectance between the thermal dye image receiver element and the substrate of at least 20%.

DETAILED DESCRIPTION OF THE INVENTION

Definitions

As used herein to define various components of the various compositions, formulations, and layers, unless otherwise indicated, the singular forms "a", "an", and "the" are intended to include one or more of the components (that is, including plurality referents).

Each term that is not explicitly defined in the present application is to be understood to have a meaning that is commonly accepted by those skilled in the art. If the construction of a term would render it meaningless or essentially meaningless in its context, the term's definition should be taken from a standard dictionary.

The use of numerical values in the various ranges specified herein, unless otherwise expressly indicated otherwise, are considered to be approximations as though the minimum and maximum values within the stated ranges were both preceded by the word "about". In this manner, slight variations above and below the stated ranges can be used to achieve substantially the same results as the values within the ranges. In addition, the disclosure of these ranges is intended as a continuous range including every value between the minimum and maximum values.

Moreover, unless otherwise indicated, percentages refer to percents by total dry weight, for example, weight % based on total solids of either a layer, or formulations used to make a layer. Unless otherwise indicated, the percentages can be the same for either the dry layer or the total solids of the formulation used to make that layer.

Unless otherwise indicated, the terms "thermal dye image receiver element", and "receiver element" refer to embodiments of the present invention.

By the term "duplex", it is meant that both sides of the substrate (defined below) has a dye receiving layer (defined below) and therefore each side of the substrate is capable of forming (or receiving) a thermal dye image, protective laminate (film), or both, although it is not required in the method of this invention that a thermal image always be formed on both sides of the support base. "Duplex" thermal dye receiver elements are also known as "dual-coated" elements. A duplex thermal dye image receiver element of this invention can have the same or different layer arrangement and composition on both sides of the support base. Thus, in duplex thermal dye image receiver elements, the substrate can comprise a support base, and on opposing sides of the support base, at least a voided compliant layer and a dye receiving layer, in that order. A metalized layer can be present on one or both sides of the duplex thermal dye image receiver element, between the voided compliant layer and the dye receiving layer.

The term "thermal donor element" refers to an element (defined below) that can be used to thermally transfer a dye, ink, clear film (laminate), or metal, or combination thereof, to the thermal dye image receiver element.

The thermal dye image receiver element can be used in an assembly of this invention and arranged in combination or "thermal association" with one or more thermal donor elements to provide a dye image, metal image, or clear film (laminate), or combination thereof, on one or both sides using thermal transfer. Multiple thermal transfers to the same thermal dye image receiver element can provide a multi-color image on one or both sides of the substrate. In addition, a clear layer (topcoat or laminate) can also be applied to one or both sides of the substrate, for example to cover a multicolor image on one or both sides of the substrate.

The term "thermal association" refers to two different elements that are disposed or arranged in a relationship that allows thermal transfer of a dye, metal, or clear film. Such relationship does not necessarily require physical contact of the two elements.

The term "voided" is used to refer to the voided or foamed compliant layer as having added solid matter that cause voids in the continuous layer phase, voids containing a gas (such as polymeric vesicles), or voids containing gases due to thermal decomposition of a chemical foaming agent or the introduction of a gas (such as a physical blowing agent). The term "foamed" refers to creation of voids using entrapped gases as described below. Thus, the term "voided" is intended to encompass "foamed" or "cavitated" embodiments of a compliant layer. Such voided layers, such as the voided compliant layer, can be considered as "low density layers". These layers are designed to be "compliant" to enable good contact between a thermal print head, thermal donor element, and the thermal dye image receiver element of this invention.

The term "extruded" refers to a layer that is applied using extrusion techniques as opposed to being coated out of an aqueous or organic solvent coating formulation.

The term "aqueous-coated" refers to a layer that is applied or coated out of an aqueous coating formulation and comprises water-soluble or water-dispersible components and more than 50 volume % of water in the solvent medium.

The term "solvent-coated" refers to a layer that is applied or coated out of an organic solvent coating formulation and comprises organic solvent-soluble or -dispersible components and more than 50 volume % of one or more organic solvents in the solvent medium.

Unless otherwise indicated, the terms "polymer" and "resin" are used interchangeably.

Substrate

The substrate is generally a multi-layer material comprising at least, in order, a voided compliant layer, and a metalized layer. The voided compliant layer can be disposed on a support base. Optional layers (described below) can also be present.

Support Base:

In many embodiments, the substrate comprises a support base, such as a raw paper base comprising cellulose fibers, a synthetic paper comprising synthetic polymer fibers, or a resin coated paper. But other support bases such as fabrics and polymer sheets can be used. The support base can be any single- or multi-layer material typically used for such purposes in imaging elements.

The resins used on the bottom or wire side (backside) of a raw paper base can be thermoplastics like polyolefins such as polyethylene, polypropylene, copolymers of these resins, or blends of these resins. The thickness of the resin layer on the bottom side of the raw paper base can range from at least 5 μm and up to and including 75 μm and typically at least 5 μm and up to and including 40 μm. The thickness and resin composition of the resin layer(s) can be adjusted to provide desired curl characteristics. The surface roughness of this resin layer can be adjusted to provide desired conveyance properties in thermal imaging printers.

When a bi-axially oriented voided compliant layer (described above) is adhered to the support base on the imaging side, a similar but non-voided bi-axially film or sheet (with or without skin layers) can be adhered to the support base on the backside to control curl, using a suitable adhesive layer having a composition like those described below for imaging side adhesive layers.

The support base can be transparent or opaque, reflective or non-reflective. Useful opaque support bases include plain papers, coated papers, resin-coated papers such as polyolefin-coated papers, synthetic papers, low density foam core based supports, and low density foam core based papers, photographic paper supports, melt-extrusion-coated papers, and polyolefin-laminated papers. Thus, useful support bases include a broad range of papers, from high end papers, such as photographic paper to low end papers, such as newsprint. In one embodiment, paper supports as described in U.S. Pat. No. 5,288,690 (Warner et al.) and U.S. Pat. No. 5,250,496 (Warner et al.), both incorporated herein by reference, can be used. Raw paper base can be made on a standard continuous fourdrinier wire machine or on other modern paper formers, using a suitable pulp. They can be "smooth" so as to not interfere with the viewing of images. Pulps can be obtained from frees such as maple and eucalyptus trees. Chemical additives to impart hydrophobicity (sizing), wet strength, and dry strength can be used as needed. Inorganic filler materials such as titanium dioxide, talc, mica, barium sulfate and calcium carbonate clays can be included to enhance optical properties. Dyes, biocides, and processing chemicals can also be used as needed. The raw paper bases can also be treated with smoothing operations such as dry or wet calendaring. Basis weights of the raw base can range from at least 50 g/m$^2$ to and including 300 g/m$^2$, typically from at least 100 g/m$^2$ to and including 250 g/m$^2$, or more likely at least 100 g/m$^2$ to and including 200 g/m$^2$.

A particularly useful substrate comprises is a raw paper base that is coated with a resin on either side. Bi-axially oriented support bases include a raw paper base and a bi-axially oriented polyolefin sheet, typically polypropylene, laminated to one or both sides of the raw paper base. Commercially available oriented and non-oriented polymer films, such as opaque bi-axially oriented polypropylene or polyester, can also be used. Such support bases can contain pigments, air voids, or foam voids to enhance opacity. The support base can also comprise microporous materials such as polyethylene polymer-containing material sold by PPG Industries, Inc., Pittsburgh, Pa. under the trade name of Teslin®, Tyvek® synthetic paper (DuPont Corp.), impregnated paper such as Duraform®, and OPPalyte® films (Mobil Chemical Co.) and other composite films listed in U.S. Pat. No. 5,244,861 (Campbell et al.) that is incorporated herein by reference. Microvoided composite bi-axially oriented sheets can be utilized and are conveniently manufactured by co-extrusion of the core and surface layers, followed by bi-axial orientation, whereby voids are formed around void-initiating material contained in the core layer. Such composite sheets are disclosed in, for example, U.S. Pat. No. 4,377,616 (Ashcraft et al.), U.S. Pat. No. 4,758,462 (Park et al.), and U.S. Pat. No. 4,632,869 (Park et al.), the disclosures of which are incorporated herein by reference.

The support base can be voided, which means comprising voids that are formed from added solid and liquid matter, or "voids" containing gas. The void-initiating particles, which remain in the finished packaging sheet core, should be from at least 0.1 μm and up to and including 10 μm in diameter and typically round in shape to produce voids of the desired shape and size. The size of the void is also dependent on the degree of orientation in the machine and transverse directions. Ideally, the voids would assume a shape that is defined by two opposed, and edge contacting, concave disks. In other words, the voids tend to have a lens-like or biconvex shape. The voids are oriented so that the two major dimensions are aligned with the machine and transverse directions of the sheet. The Z-direction axis is a minor dimension and is roughly the size of the cross diameter of the voiding particle. The voids can be created in various ways as described above. The particularly useful voids generally tend to be closed cells, and thus there is virtually no path open from one side of the voided-core to the other side through which gas or liquid can traverse.

Bi-axially oriented sheets, while described as having at least one layer, can also be provided with additional layers that can serve to change the properties of the bi-axially oriented sheet. Such layers might contain tints, antistatic or conductive materials, or slip agents to produce sheets of unique properties. Bi-axially oriented sheets can be formed with surface layers, referred to herein as skin layers (see below) that are designed to promote adhesion to adjacent layers. The bi-axially oriented extrusion can be carried out with as many as 10 layers if desired to achieve some particular desired property. The bi-axially oriented sheet can be made with layers of the same polymeric material, or it can be made with layers of different polymeric composition. For compatibility, an auxiliary layer can be used to promote adhesion of multiple layers.

Transparent support bases include glass, cellulose derivatives, such as a cellulose ester, cellulose triacetate, cellulose diacetate, cellulose acetate propionate, cellulose acetate butyrate, polyesters, such as poly(ethylene terephthalate), poly(ethylene naphthalate), poly-1,4-cyclohexanedimethylene terephthalate, poly(butylene terephthalate), and copolymers thereof, polyimides, polyamides, polycarbonates, polystyrene, polyolefins, such as polyethylene or polypropylene, polysulfones, polyacrylates, polyether imides, and mixtures thereof. The term as used herein, "transparent" means the ability to pass visible radiation without significant deviation or absorption.

The support base used in the invention can have a thickness of at least 50 μm and up to and including 300 μm or typically at least 100 μm and up to and including 250 μm. Antioxidants, brightening agents, antistatic or conductive agents, plasticizers and other additives can be incorporated into the support base, if desired.

For example, useful antistatic agents include but are not limited to, metal particles, metal oxides, inorganic oxides, metal antimonates, inorganic non-oxides, and electronically conductive polymers, examples of which are described in U.S. Patent Application Publication 2011/0091667 (Majumdar et al.) that is incorporated herein by reference. Particularly useful antistatic agents are inorganic or organic electrolytes. Alkali metal and alkaline earth salts (or electrolytes) such as sodium chloride, potassium chloride, and calcium chloride, and electrolytes comprising polyacids are also useful. For example, alkali metal salts include lithium, sodium, or potassium polyacids such as salts of polyacrylic acid, poly(methacrylic acid), maleic acid, itaconic acid, crotonic acid, poly (sulfonic acid), or mixed polymers of these compounds. Alternatively, the raw base support can contain various clays such as smectite clays that include exchangeable ions that impart conductivity to the raw base support. Polymerized alkylene oxides, such as combinations of polymerized alkylene oxide and alkali metal salts as described in U.S. Pat. No. 4,542,095 (Steklenski et al.) and U.S. Pat. No. 5,683,862 (Majumdar et al.) are useful as electrolytes.

The antistatic agents can be present in the support base in an amount of up to and including 2 weight % or typically at least 0.01 weight % and up to and including 1.5 weight % based on the total support base dry weight.

In other embodiments, the support base comprises a synthetic paper that is typically cellulose-free, having a polymer core that has adhered thereto at least one flange layer. The polymer core comprises a homopolymer such as a polyolefin, polystyrene, polyester, polyvinylchloride, or other typical thermoplastic polymers, their copolymers or their blends thereof, or other polymeric systems like polyurethanes and polyisocyanurates. These materials can be expanded either through stretching resulting in voids or through the use of a blowing agent to consist of two phases, a solid polymer matrix, and a gaseous phase. Other solid phases can be present in the form of fillers that are of organic (polymeric or fibrous) or inorganic (glass, ceramic, or metal) origin. The fillers can be used for physical, optical (lightness, whiteness, and opacity), chemical, or processing property enhancements of the core.

In still other embodiments, the substrate comprises a synthetic support based that is a cellulose-free paper having a foamed polymer core or a foamed polymer core that has adhered thereto at least one flange layer. The polymers described for use in a polymer core can also be used in manufacture of the foamed polymer core layer, carried out through several mechanical, chemical, or physical means. Mechanical methods include whipping a gas into a polymer melt, solution, or suspension, which then hardens either by catalytic action or heat or both, thus entrapping the gas bubbles in the matrix. Chemical methods include such techniques as the thermal decomposition of chemical blowing agents generating gases such as nitrogen or carbon dioxide by the application of heat or through exothermic heat of reaction during polymerization. Physical methods include such techniques as the expansion of a gas dissolved in a polymer mass upon reduction of system pressure, the volatilization of low-boiling liquids such as fluorocarbons or methylene chloride, or the incorporation of hollow microspheres in a polymer matrix. The choice of foaming technique is dictated by desired foam density reduction, desired properties, and manufacturing process. The foamed polymer core can comprise a polymer expanded through the use of a blowing agent.

In some embodiments, polyolefins such as polyethylene and polypropylene, their blends and their copolymers are used as the matrix polymer in the foamed polymer core along with a chemical blowing agent such as sodium bicarbonate and its mixture with citric acid, organic acid salts, azodicarbon-amide, azobisformamide, azobisisobutyrolnitrile, diazoaminobenzene, 4,4'-oxybis(benzene sulfonyl hydrazide) (OBSH), N,N'-dinitrosopentamethyl-tetramine (DNPA), sodium borohydride, and other blowing agent agents well known in the art. Useful chemical blowing agents would be sodium bicarbonate/citric acid mixtures, azodicarbonamide; though others can also be used. These foaming agents can be used together with an auxiliary foaming agent, nucleating agent, and a cross-linking agent.

Voided Compliant Layer:

A voided compliant layer in the substrate can be disposed over the support base. The voided compliant layer comprises uni- or bi-axially-oriented polypropylene, uni- or bi-axially oriented poly(ethylene terephthalate), foamed polypropylene, foamed poly(ethylene terephthalate), polylactic acid, and other known polyolefin and polyester films. The amount of such polymers in the voided compliant layer can be at least 75 weight % and up to and including 100 weight % based on total dry voided compliant layer weight. In addition, the voided compliant layer can include one or more elastomeric resins in an amount of up to 25 weight %, based on total dry voided compliant layer weight. Elastomeric resins can include blends of ethylene/ethyl acrylate copolymers (EEA), ethylene/butyl acrylate copolymers (EBA), or ethylene/methyl acrylate copolymers (EMA) with SEBS like Kraton® G1657M; EEA, EBA, or EMA with SEBS and polypropylene; EEA, EBA, or EMA polymers with SEBS and polystyrene; EEA or EMA with SEBS and cyclic polyolefins (like Topas® resins); polypropylene with Kraton® polymers like FG1924, G1702, G1730M; polypropylene with ethylene propylene copolymers like Exxon Mobil's Vistamaxx™ grades; or blends of low density polyethylene (LDPE) with amorphous polyamide like Dupont's Selar and Kraton® FG grade of polymers and an additive compound such as maleated polyethylene (Dupont Bynel® grades, Arkema's Lotader® grades). These voided compliant layers can be applied by extrusion techniques known in the art.

To provide a "foamed" voided compliant layer, the polymers used in the layer can include a foamed polymer core layer that is obtained using any mechanical, chemical, or physical means. Mechanical methods include whipping a gas into a polymer melt, solution, or suspension, which then hardens either by catalytic action or heat or both, thus entrapping the gas bubbles in the matrix. Chemical methods include such techniques as the thermal decomposition of chemical blowing agents generating gases such as nitrogen or carbon dioxide by the application of heat or through exothermic heat of reaction during polymerization. Physical methods include such techniques as the expansion of a gas dissolved in a polymer mass upon reduction of system pressure, the volatilization of low-boiling liquids such as fluorocarbons or methylene chloride, or the incorporation of hollow microspheres in a polymer matrix. The choice of foaming technique is dictated by desired foam density reduction, desired properties, and manufacturing process. The foamed polymer core can comprise a polymer expanded through the use of a blowing agent.

Polyolefins such as polyethylene and polypropylene, their blends, and their copolymers can be used as a matrix polymer in the voided compliant layer along with a chemical blowing agent such as sodium bicarbonate and its mixture with citric acid, organic acid salts, azodicarbonamide, azobisformamide, azobisisobutyrolnitrile, diazoaminobenzene, 4,4'-oxybis(benzene sulfonyl hydrazide) (OBSH), N,N'-dinitrosopentamethyl-tetramine (DNPA), sodium borohydride, and other blowing agent agents well known in the art. Useful chemical blowing agents would be sodium bicarbonate/citric acid mixtures, azodicarbonamide; though others can also be used. These foaming agents can be used together with an auxiliary foaming agent, nucleating agent, and a cross-linking agent.

The dry thickness of the voided compliant layer is generally at least 15 μm and up to and including 70 μm or typically at least 20 μm and up to and including 45 μm. It can be advantageous in various embodiments that the dry thickness ratio of the voided compliant layer (on one or both sides of the substrate) to the support base is at least 0.08:1 and up to and including 0.5:1 or at least 0.1:1 and up to and including 0.33:1.

The voided compliant layer can be applied by extrusion using high temperature extrusion processes like cast extrusion, cast and orient, or hot melt at a temperature of at least 100° C. and up to and including 300° C. Useful extrusion speeds are high speeds due to productivity constraints and for economical reasons. In some instances, the resulting extruded, voided compliant layer can have a thickness greater than the final thickness obtained at slow speeds, but it is then stretched or made thinner by an orientation process that results in coating on a support at a higher speed. A less desirable variation of the orientation process is biaxial orientation of the extruded, voided compliant layer and laminating it to a support. The choice of manufacturing operation would be dependent upon the choice of voided compliant layer composition. For example, using polypropylene or polyester as the matrix material makes it possible to use either extrusion coating or a uni-axial or bi-axial orientation process.

The voided compliant layer can be formed by co-extrusion with one or more optional skin layers (described below) immediately adjacent either or both sides of the voided compliant layer.

The voided compliant layer can also include additives such as chill roll release agents, antioxidants, and UV stabilizers. However, the voided compliant layer is generally free of opacifying agents that are used elsewhere in the receiver element. Thus, no opacifying agents (described below) are intentionally incorporated into the layer formulation. If opacifying agents are present, it is in an amount of less than 5 dry weight %.

The voided compliant layer can be present on one or both sides of the support base, and if a voided compliant layer is on both sides of the support base, they can have the same or different composition and additives.

The voided compliant layer, with or without skin layers, can be adhered to the support base using a suitable adhesive layer. These adhesive layers can generally comprise one or more polymeric materials such as low- or high-density polyethylene and mixtures thereof, or other pressure or temperature sensitive adhesive materials, and can be applied using extrusion or solvent coating techniques.

Optional Skin Layers:

Optionally, a skin layer can be directly adjacent one or more sides of the voided compliant layer on either or both sides of the support base and they can act as adhesive layers. Such skin layers can be co-extruded with the voided compliant layer, or they can be separately extruded and adhered using an adhesive layer. Such optional skin layers can be free of opacifying agents or they can comprise one or more opacifying agents in an amount of at 2 weight % and up to and including 40 weight % based on total dry skin layer weight. The opacifying agents include but are not limited to, titanium dioxide, barium sulfate, calcium carbonate, zinc sulfide, and mixtures thereof. Titanium dioxide is a particularly useful opacifying agent when used alone or in mixtures with other opacifying agents. For example, an opacifying layer directly adjacent each side of the voided compliant layer can include titanium dioxide as the only opacifying agent.

The skin layers are generally composed of one or more polymeric materials including but not limited to, polyolefins such as polyethylene, polypropylene, copolymers of ethylene and propylene, functionalized polyolefins, polyesters, copolymers of ethylene, like ethylene/methyl acrylate (EMA) copolymers, ethylene/butyl acrylate (EBA) copolymers, ethylene/ethyl acrylate (EEA) copolymers, ethylene/methyl acrylate/maleic anhydride copolymers, and blends of these polymers. Such polymeric materials enable the skin layer to be applied to the voided compliant layer by extrusion using conditions and processes described below. Each optional skin layer can have a dry thickness of at least 0.5 μm and up to and including 5 μm. For example, the dry thickness ratio of each of the adjacent skin layers, when present, to the dry thickness of the voided compliant layer can be at least 0.025:1 and up to and including 0.2:1.

The skin layer can be composed of any of the polymeric materials described above, antioxidants, colorants, anti-block agents, or other addenda normally used in such layers. It can be co-extruded with other extruded layers.

Each skin layer can be extruded individually or co-extruded with other extruded layers (such as the voided compliant layer), or applied by aqueous or organic solvent coating methods.

Metalized Layer:

The metalized layer present in the substrate of the receiver element can be formed of a single or multiple strata of one or more metallic pigments, metals, or other metal-containing compounds. The metalized layer can be applied over or directly to the voided compliant layer (or intervening skin layer) in any suitable manner including solvent coating, vacuum deposition, sputtering, or spray coating. It can also be adhered to the voided compliant layer (or any intervening skin layer) as a metal foil. Such application techniques are described in U.S. Pat. No. 5,192,620 (Chu et al.), U.S. Pat. No. 5,698,368 (Obata et al.), U.S. Pat. No. 5,932,325 (Shunichi et al.), U.S. Pat. No. 6,165,611 (Hirano et al.), and U.S. Pat. No. 7,521,102 (Morizumi et al.), all of which are incorporated herein for the teaching relating to metalized layers and methods of formation. A metalized layer can be present on either or both sides of the support base. If a metalized layer is on both sides of the support base, the two layers can have the same or different composition or thickness. In some embodiments, a metalized layer is present on both sides of a duplex thermal dye image receiver element, but in other duplex embodiments, a metalized layer is present on only one side of the support base.

The metalized layer should have a reflectance greater than 85% of the visible spectrum of radiation and should be relatively flat and free of roughness. Useful metals that can be included in the metalized layer include but are not limited to, aluminum, nickel, gold, copper, titanium, silver, and metallic alloys. Metal oxides, metal nitrides, metal sulfides and other metal-containing compounds can also be used as long as they satisfy the reflectance requirement. Aluminum layers formed using metal flakes are particularly useful, and the use of aluminum flakes with or without a thermoplastic polymeric binder is described in U.S. Pat. No. 5,312,683 (Chou et al.)

and U.S. Pat. No. 6,703,088 (Hayashi et al.) that are incorporated herein by reference for their teaching about the preparation of metalized layers.

The metal or metal-containing compound in the metalized layer can generally comprises at least 90 weight % of the metalized layer weight, and there can be up to 10 weight % one or more polymeric binders if needed to give the layer strength and integrity, or to enhance coatability.

The dry thickness of the metalized layer on either or both sides of the support base is at least 300 Å and up to and including 1000 Å, or typically at least 300 Å and up to and including 600 Å, especially when the metalized layer is an aluminum or aluminum-containing layer.

In most embodiments, the ratio of the dry thickness of the metalized layer to the opacifying layer is at least 0.005:1 to and including 0.2:1, or typically at least 0.01:1 to and including 0.1:1.

Opacifying Layer

An opacifying layer that can be an aqueous-coated or organic solvent-coated layer is located between the metalized layer of the substrate and the dye receiving layer on either or both sides of the support base. One or more opacifying agents are present in an amount of at least 1 weight % and up to and including 20 weight % based on total dry opacifying layer weight. In general, one or more opacifying agents can be present in the opacifying layer in an amount sufficient to provide the thermal dye image receiver with a reflectance of at least 10% and up to and including 50%, or typically at least 20% and up to and including 40%, as determined by reflectance of specular reflectance techniques.

In addition, the difference in reflectance between the thermal dye image receiver element and the substrate (described above) is at least 20% and typically at least 30%, as determined by measuring the spectral reflectance of the substrate.

Useful opacifying agents include but are not limited to, titanium dioxide, barium sulfate, calcium carbonate, zinc sulfide, and mixtures thereof. The opacifying agent present in these opacifying layers can be the same or different from the opacifying agent(s) used in the optional opacifying layer that is directly adjacent the voided compliant layer. Titanium dioxide is a particularly useful opacifying agent and can be present alone or in mixtures with other opacifying agents. The opacifying layers on opposing sides of the support based in the duplex receiver elements can have the same or different composition and thickness.

One or more water-dispersible polymeric binders can be present as a matrix for the opacifying agents, in an amount of at least 80 weight % and up to and including 99 weight % based on the total dry opacifying layer weight. Useful binders include but are not limited to, water-dispersible vinyl polymers, water-dispersible polyesters, and water-dispersible polyurethanes. The opacifying layer composition can also be designed to promote adhesion between the metalized layer and dye receiving layer.

The opacifying layer can contain additional components such as colorants, optical brighteners, and antistatic agents.

The opacifying layer can coated as an aqueous formulation having the desired materials in suitable amounts to provide the desired dry coverage and thickness, or it can be formed by extrusion. The dry thickness of the opacifying layer is at least 0.2 μm and up to and including 3 μm, and typically at least 0.3 μm and up to and including 2 μm. For example, for aqueous-coated opacifying layers, the dry thickness if generally at least 0.1 μm to and including 1 μm, and the extruded opacifying layers can have a dry thickness of at least 0.5 μm to and including 3 μm. Representative formulations and methods of coating the opacifying layer are described below in the Examples.

Dye Receiving Layer

The dye receiving layer used in the thermal dye image receiver element can be formed in any suitable manner, for example using organic solvent or aqueous coating techniques such as curtain coating, dip coating, solution coating, printing, or extrusion coating as is known in the art, for example in U.S. Pat. No. 5,411,931 (Kung), U.S. Pat. No. 5,266,551 (Bailey et al.), U.S. Pat. No. 6,096,685 (Pope et al.), U.S. Pat. No. 6,291,396 (Bodem et al.), U.S. Pat. No. 5,529,972 (Ramello et al.), and U.S. Pat. No. 7,485,402 (Arai et al.), all of which are incorporated herein by reference.

In some embodiments, the dye receiving layer is extruded onto the opacifying layer. Alternatively, the two layers can be co-extruded onto the metalized layer. The details of such dye receiving layers are provided for example in U.S. Pat. No. 7,091,157 (Kung et al.) that is incorporated herein by reference. Further details about dye receiving layers can be obtained from U.S. Patent Application Publications 2010/0327480 and 2010/0330306 (both noted above) that are also incorporated herein by reference. Such layers can comprise, for example, a polycarbonate, polyurethane, polyester, vinyl polymer [such as a polyolefin, polyvinyl chloride, or poly (styrene-co-acrylonitrile)], poly(caprolactone), or mixtures or blends thereof.

The dye receiver layer generally has an initial thickness and if it is extruded, it can be uni-axially stretched to a dry thickness of less than 50 μm or typically less than 20 μm. In many embodiments, the final dry thickness of the dye receiving layer is at least 1 μm and up to and including 10 μm, and typically at least 1 μm and up to and including 5 μm with the optimal thickness being determined for the intended purpose. The dye receiver layer dry coverage for example can be at least 0.5 $g/m^2$ and up to and including 20 $g/m^2$ or typically at least 1 $g/m^2$ and up to and including 10 $g/m^2$.

It is also sometimes desirable for the dye receiving layer to also comprise other additives such as lubricants that can enable improved conveyance through a printer. An example of a lubricant is a polydimethylsiloxane-containing copolymer such as a polycarbonate random terpolymer of bisphenol A, diethylene glycol, and polydimethylsiloxane block unit and can be present in an amount of at least 3 weight % and up to and including 30 weight % based on dry dye receiving layer weight. Other additives that can be present are plasticizers such as esters or polyesters formed from a mixture of 1,3-butylene glycol adipate and dioctyl sebacate. The plasticizer would typically be present in an amount of at least 3 weight % and up to and including 20 weight % based on dry dye receiving layer weight.

A dye receiving layer can be present on one or both sides of the support base, and can be single- or multi-layered. Thus, images can be formed on either or both opposing sides of the receiver element.

The dry thickness ratio of the dye receiving layer to the voided compliant layer (on either side of the receiver element) can be at least 0.04:1 and up to and including 0.5:1 or typically of at least 0.06:1 and up to and including 0.3:1.

In addition, the ratio of the dry thickness of the metalized layer to the dry thickness of the dye receiving layer can be at least 0.005:1 and up to and including 0.05:1, or typically at least 0.01:1 and up to and including 0.05:1, or more likely at least 0.01:1 and up to and including 0.03:1.

Preparation of Receiver Elements

The various layers described above to form the substrate, opacifying layer, and dye receiving layer can be formed using the described components using extrusion, organic solvent coating, or aqueous coating techniques that would be apparent to one skilled in the art in view of the teaching presented in this disclosure including the working examples present below. The coating equipment and techniques are well known as the present invention is not focused on the methods of preparing the receiver elements, but relates to the types of arrangements of layers. Once the specific layers and their orders are appreciated, a skilled worker would be able to make the receiver elements.

For example, a support base and a voided compliant layer can be formed independently. After formation of the support based and voided compliant layer (with or without skin, adhesive, or tie layers), the metalized layer can be applied by organic solvent coating or vacuum deposition methods, or it can be laminated or adhered to the voided compliant layer using lamination methods. The voided compliant layer with an adhered metalized layer can be laminated to the support base. An aqueous-coated opacifying layer can be applied over the metalized layer, and to this opacifying layer, a dye receiving layer is applied in a suitable manner. Co-extruded layers can be stretched or oriented to reduce the thickness. Thus, the entire multi-layer structure of the thermal dye image receiver element can be applied in a multi-step process.

When the dye receiving layer is organic- or aqueous-coated, it can be crosslinked during the coating or drying operation, or it can be crosslinked later by an external means such as UV irradiation. A preferred composition for providing a crosslinked dye receiving layer is a polycarbonate crosslinked using an isocyanate crosslinking agent.

Thermal Donor Elements

Thermal donor elements (also known as dye donor elements) that can be used with the thermal dye image receiver elements of this invention generally comprise a support having thereon a thermal transfer layer comprising at least one thermally transferable material such as an ink, dye, clear film (laminate), or metal.

Any ink or dye can be used in the thermal donor element provided that it is transferable to the dye receiving layer by the action of heat. Thermal donor elements are described, for example, in U.S. Pat. No. 4,916,112 (Henzel et al.), U.S. Pat. No. 4,927,803 (Bailey et al.), and U.S. Pat. No. 5,023,228 (Henzel) that are all incorporated herein by reference. In addition, a protective clear film (laminate) can be transferred to either or both sides of the thermal dye image receiver element. Thermal transfer of an ink or dye comprises image-wise-heating a thermal donor element and transferring an ink or dye image material to either or both sides of the thermal dye image receiver element as described above to form the transfer image on either or both sides. In some embodiments, both sides of the thermal dye image transfer receiver element are imaged using the same or different thermal donor elements.

A thermal donor element can be employed that comprises a poly(ethylene terephthalate) support coated with ribbons or sequential repeating areas (patches) of cyan, magenta, or yellow ink or dye, and the ink or dye transfer steps can be sequentially performed for each color to obtain a multi-color ink or dye transfer image on either or both sides the receiver element. The support can also include a black ink patch or ribbon. The thermal donor element support can also include a clear protective layer (laminate) or patch that can be thermally transferred to provide a protective overcoat or laminate. When the process is performed using only a single color, then a monochrome ink or dye image can be obtained. More likely, a multicolor image is provided by thermal transfer of multiple inks or dyes from multiple patches or donor elements.

The thermal donor layer can include a single color area (patch) or multiple colored areas (patches) containing dyes suitable for thermal printing. As used herein, a "dye" can be one or more dye, pigment, colorant, or a combination thereof, and can optionally be in a binder or carrier as known to practitioners in the art. For example, the thermal dye layer can include a magenta dye patch and further comprise a yellow dye patch comprising at least one bis-pyrazolone-methine dye and at least one other pyrazolone-methine dye, and a cyan dye patch comprising at least one indoaniline cyan dye.

The thermally transferable dye can be selected by taking into consideration hue, lightfastness, and solubility of the dye in the thermal donor layer binder and the image receiving layer binder(s). Further examples of useful thermal transferable dyes can be found in U.S. Pat. No. 4,541,830 (Hotta et al.), U.S. Pat. No. 4,698,651 (Moore et al.), U.S. Pat. No. 4,695,287 (Evans et al.), U.S. Pat. No. 4,701,439 (Evans et al.), U.S. Pat. No. 4,757,046 (Byers et al.), U.S. Pat. No. 4,743,582 (Evans et al.), U.S. Pat. No. 4,769,360 (Evans et al.), U.S. Pat. No. 4,753,922 (Byers et al.), U.S. Pat. No. 4,910,187 (Sato et al.), U.S. Pat. No. 5,026,677 (Vanmaele), U.S. Pat. No. 5,101,035 (Bach et al.), U.S. Pat. No. 5,142,089 (Vanmaele), U.S. Pat. No. 5,374,601 (Takiguchi et al.), U.S. Pat. No. 5,476,943 (Komamura et al.), U.S. Pat. No. 5,532,202 (Yoshida), U.S. Pat. No. 5,804,531 (Evans et al.), U.S. Pat. No. 6,265,345 (Yoshida et al.), and U.S. Pat. No. 7,501,382 (Foster et al.), and U.S. Patent Application Publications 2003/0181331 (Foster et al.) and 2008/0254383 (Soejima et al.), the disclosures of which are hereby incorporated by reference.

The dyes can be employed singly or in combination to obtain a monochrome dye donor layer or a black dye donor layer. The dyes can be used in an amount of at least 0.05 $g/m^2$ and up to and including 1 $g/m^2$ of coverage in the dye-donor layer.

Clear polymeric films can be thermally transferred to the thermal dye image receiver element to provide a protective laminate over dye images, as described for example in U.S. Patent Application Publication 2010/0218887 (Vreeland) that is incorporated herein by reference.

In particular, the thermal donor element can provide a protective overcoat layer patch (or protective material) on a thermal print provided by uniform application of heat using a thermal head. The protective overcoat layer, which can also be referred to as a protective overcoat or protective overcoat patch, can include at least one poly(vinyl acetal) resin of the following Formula I:

Formula I

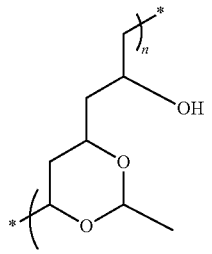

wherein n is from 10 to 100. The average molecular weight can be in the range of from about 4,000 to about 100,000, for example from about 15,000 to about 80,000. Optionally, the protective overcoat layer can also include at least one styrene/allyl alcohol copolymer resin, such as Lyondell SAA-100.

As described in the noted U.S. Patent Application Publication 2010/0218887, any of the dye patches or protective overcoat layer can also include an N-oxyl radical light stabilizer, for example but not limited to, the compound defined by the following Formula III, known as TEMPO:

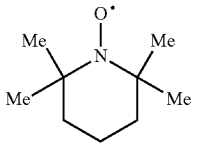

In some embodiments, the protective overcoat layer is the only layer on the donor element and it can be used in conjunction with a dye thermal donor element that contains the heat transferable image dyes.

It is also possible to use the thermal donor element to transfer metals for various metallic effects with a color image to the thermal dye image receiver element of this invention, using processes as described for example, in U.S. Pat. No. 5,312,683 (Chou et al.), U.S. Pat. No. 5,464,723 (Chou), U.S. Pat. No. 5,643,659 (Kobayashi et al.), U.S. Pat. No. 5,698,368 (Obata et al.), and U.S. Pat. No. 6,703,088 (Hayashi et al.), all that are incorporated herein by reference.

The present invention provides at least the following embodiments and combinations thereof, but other combinations of features are considered to be within the present invention as a skilled artisan would appreciate from the teaching of this disclosure:

1. A thermal dye image receiver element comprising, in order:
A) a substrate comprising, in order:
a voided compliant layer, and
a metalized layer,
B) an opacifying layer, and
C) a dye receiving layer,
wherein the opacifying layer comprises an opacifying agent in an amount sufficient to provide the thermal dye image receiver element with a reflectance of at least 10% and up to and including 50%.

2. The thermal dye image receiver element of embodiment 1, wherein the substrate comprises, in order:
a support base,
a voided compliant layer, and
a metalized layer.

3. The thermal dye image receiver element of embodiment 1 or 2, wherein the metalized layer has a dry thickness of at least 300 Å and up to and including 1000 Å.

4. The thermal dye image receiver element of any of embodiments 1 to 3, wherein the metalized layer has a dry thickness of at least 300 Å and up to and including 600 Å.

5. The thermal dye image receiver element of any of embodiments 1 to 4, wherein the opacifying layer comprises an opacifying agent that is selected from the group consisting of titanium dioxide, barium sulfate, calcium carbonate, zinc sulfide, and mixtures thereof.

6. The thermal dye image receiver element of any of embodiments 1 to 5, wherein the opacifying layer comprises one or more opacifying agents in a total amount of at least 5 $mg/m^2$ and up to and including 20 $mg/m^2$.

7. The thermal dye image receiver element of any of embodiments 1 to 6, wherein the ratio of the dry thickness of the metalized layer to the dry thickness of the dye receiving layer is at least 0.005:1 and up to and including 0.05:1.

8. The thermal dye image receiver element of any of embodiments 1 to 7 that is a duplex thermal dye image receiver element comprising, on both sides of the substrate, the same or different voided compliant layer, metalized layer, and B) and C) layers.

9. The thermal dye image receiver element of embodiment 8, wherein the duplex thermal dye image receiver element comprises the same voided compliant layer, metalized layer, and B) and C) layers on both sides of the substrate.

10. The thermal dye image receiver element of any of embodiments 1 to 7 that is a duplex thermal dye image receiver element, comprising, in order: a support base, a voided compliant layer, a metalized layer, an opacifying layer, and a dye receiving layer, and
comprising on the opposing side of the support base, in order, the same or different compliant layer, and the same or different dye receiving layer.

11. The thermal dye image receiver element of any of embodiments 1 to 10 comprising a polymeric skin layer directly adjacent one or both sides of the voided compliant layer, wherein each of these polymeric skin layers optionally contains titanium dioxide.

12. The thermal dye image receiver element of any of embodiments 1 to 11, wherein the metalized layer comprises aluminum 13. The thermal dye image receiver element of any of embodiments 1 to 12 wherein the substrate comprises a raw paper base, a voided compliant layer that comprises uni- or bi-axially oriented polypropylene, uni- or bi-axially oriented poly(ethylene terephthalate), foamed polypropylene, or foamed poly(ethylene terephthalate), a polymeric skin layer directly on either or both sides of the voided compliant layer, and aluminum metalized layer.

14. The thermal dye image receiver element of any of embodiments 1 to 13, wherein:
A) the substrate comprises, in order:
a raw paper support base,
an adhesive layer,
a voided compliant layer,
a polymeric skin layer directly adjacent at least one side of the compliant layer, the polymeric skin layer optionally comprising titanium dioxide, and
an aluminum layer having a dry thickness of at least 300 Å and up to and including 600 Å,
B) the opacifying layer comprises one or more opacifying agents that includes titanium dioxide in a total amount of at least 5 $mg/m^2$ and up to and including 20 $mg/m^2$, to provide a reflectance of at least 10% and up to and including 35%.

15. An assembly comprising the thermal dye image transfer receiver element of any of embodiments 1 to 14 in thermal association with a thermal donor element.

16. A method comprising thermally imaging the thermal dye image receiver element of any of embodiments 1 to 14 in thermal association with a thermal donor element to provide a thermal dye image, a protective laminate, or both, in the thermal dye image receiver element.

17. The method of embodiment 16, wherein the thermal dye image receiver element is a duplex element, and the method comprises imaging one or more both sides of the thermal dye image receiver element using the same or different thermal donor element, to provide the same or different thermal dye image, protective laminate, or both, independently to both sides of the thermal dye image receiver element.

The following Examples are provided to illustrate the practice of this invention and are not meant to be limiting in any manner.

Comparison Example 1

A thermal dye image receiver element was prepared by extrusion laminating a three layer biaxially-oriented voided polypropylene film (350K18, ExxonMobil Chemical, Macedon, N.Y.) of caliper 33.02 μm to one side of a paper support base of caliper 132.08 μm to form the face side of a laminated substrate. A mixture of high and low density polyethylene was used in an adhesive layer to adhere the film to the paper support base. To balance the curl of the substrate, a biaxially-oriented polypropylene film (70MLT, ExxonMobil Chemical, Macedon, N.Y.) of caliper 17.78 μm was laminated to the back side of the paper support base using a mixture of high and low density polyethylene as an adhesive (or tie) layer. The total caliper of this laminated substrate was 213.36 μm.

A dye receiver layer (DRL) and extrudable adhesive tie layer were simultaneously applied to the face side of the laminated substrate to form a thermal dye image receiver element (Comparison Example 1). The compositions of the dye receiver layer (DRL) and the extrudable adhesive tie layer are described below, as well as the process used for preparing the melted layer compositions for coating. The ratio of DRL to tie layer thickness was 2:1, and the DRL thickness was 2 μm.

Dye Receiving Layer (DRL):

Polyester E-2 (structure and making of branched polyester described in U.S. Pat. No. 6,897,183 (Col. 15, lines 3 to 32) and U.S. Pat. No. 7,091,157 (Col. 31, lines 23 to 51) both of which are incorporated herein by reference, was dried in a Novatech desiccant dryer at 43° C. for 24 hours. The dew point was −40° C.

Lexan® 151, a polycarbonate from GE, Lexan® EXRL1414TNA8A005T, a polycarbonate from GE, and MB50-315 silicone from Dow Chemical Co. were mixed together in a 0.819:1:0.3 weight ratio and dried at 120° C. for 2-4 hours at −40° C. dew point.

Dioctyl Sebacate (DOS) was preheated to 83° C. and phosphorous acid was mixed in to make a phosphorous acid concentration of 0.4 weight %. This mixture was maintained at 83° C. and mixed for 1 hour under nitrogen before it was used.

These materials were compounded using a Leistritz ZSK 27 extruder with a 30:1 length to diameter ratio. The Lexan® polycarbonates/MB50-3,5-silicone material was introduced into the compounder first, and melted. Then the dioctyl sebacate/phosphorous acid solution was added, and finally the polyester was added. The final formula was 73.46 weight % of polyester, 8.9 weight % of Lexan® 151 polycarbonate, 10 weight % of Lexan EXRL1414TNA8A005T, 3 weight % of MB50-315 silicone, 5.33 weight % of DOS, and 0.02 weight % of phosphorous acid. A vacuum was applied with slightly negative pressure, and the melt temperature was 240° C. The melted mixture was then extruded through a strand die, cooled in 32° C. water, and pelletized. The pelletized dye receiver was then aged for about 2 weeks. The dye receiver pellets were then pre-dried before extrusion, at 38° C. for 24 hours in a Novatech dryer as described above. The dried material was then conveyed using desiccated air to the extruder. The dye receiver pellets were melted in the extruder and heated to 265° C.

Extrudable Tie (Skin) Layer:

An extrudable tie layer formulation was prepared by compounding PELESTAT® 300 antistat polymer from Sanyo Chemical Co. that was pre-dried in the above dryers at 77° C. for 24 hours. It was melt mixed in the above compounder with undried HUNTSMAN P4G2Z-159 polypropylene homopolymer in a 70/30 weight ratio at about 240° C., forced through a strand die into 20° C. water, and pelletized. The compounded tie-layer pellets are then dried again at 77° C. for 24 hours in a NOVATECH dryer, and conveyed using desiccated air to the extruder. The tie layer was melted in the extruder such that it exited the extruder at a temperature around 232° C.

The dye receiving layer and tie layer formulations were pumped through a Cloeren feedblock, the melts exiting the die at 299° C., and co-extruded onto the substrate at a thickness ratio of DRL to tie layer 2:1. The DRL dry thickness was 2 μm.

Comparison Example 2

Thermal dye image receiver element Comparison Example 2 was formed as described above in Comparison Example 1, except that a five-layer biaxially oriented voided pearlescent polypropylene film (35PC, Vibac) of caliper 35 μm was laminated to the paper support base to form the face side of a laminated substrate. The five-layer film from Vibac has a central voided compliant layer, while the adjacent layers on either side have a low amount of $TiO_2$ resulting in a pearlescent appearance to the film. The total caliper of this laminated substrate was 215.36 μm.

Comparison Example 3

Thermal dye image receiver element Comparison Example 3 was formed as described above in Comparison Example 1, except that a metalized four-layer biaxially-oriented voided pearlescent polypropylene film (70 MET, ExxonMobil Chemical, Macedon, N.Y.) of caliper 18 μm was laminated to the paper support base. The four-layer film from Exxon Mobil (70 MET) has three polymeric layers that are not voided and an outermost metalized layer of aluminum. The metalized layer was farthest from the paper support base after lamination to form the face side of the laminated substrate. The total caliper of this laminated support was 198 μm. A thermal dye receiver layer (DRL) and extrudable tie layer were simultaneously applied to the metalized face side of the laminated substrate to form a thermal dye image receiver element. The composition of the dye receiver layer was the same as described for Comparison Example 1, but the extrudable tie layer was composed of ethylene methyl acrylate copolymer (Exxon Mobil's Optema™ TC130, 20 MFR).

Comparison Example 4

Thermal dye image receiver element Comparison Example 4 was prepared as described above in Comparison Example 3, except that a five-layer biaxially oriented voided metalized polypropylene film from Exxon Mobil (28MWHB) of caliper 28 μm was laminated as the face film. Of the five layers that make up 28MWHB laminate, four layers were polymeric while the fifth outermost layer was a metal coating of aluminum. The Exxon Mobil 28MWHB has a voided polymeric layer and the immediate layers adjacent on either side had a very low amount of opacifiers or scattering sites. The aluminum layer thickness was estimated to be 353 Å using X-ray fluorescence. The metalized layer was farthest from the paper support base after lamination. The total caliper of this laminated substrate was 210.34 μm.

Comparison Example 5

Thermal dye image receiver element Comparison Example 5 was prepared as described above in Comparison Example 3, except that a five-layer biaxially oriented voided metalized polypropylene film from Exxon Mobil (35MWHB) of caliper 35 μm was laminated as the face film. The 35MWHB film had four polymeric layers, one of which was voided, while the fifth outermost layer was a metal coating of aluminum. The aluminum layer thickness was estimated to be 436.67 Å using X-ray fluorescence. The metalized layer was furthest from the paper support base after lamination. The total caliper of the laminated substrate was 217.34 μm.

Comparison Example 6

Thermal dye image receiver element Comparison Example 6 was prepared as described above for Comparison Example 3, except that a six-layer biaxially-oriented voided metalized polypropylene film from Vibac (40PZN) of caliper 40 μm was laminated as the face film. The Vibac 40PZN film had five polymeric layers. The central polymeric layer was voided while the immediate layers adjacent it on either side had a very low amount of $TiO_2$ as opacifiers or scattering sites. The sixth layer was a metal coating of aluminum with a thickness estimated to be 306.67 Å using X-ray fluorescence. The metalized layer was furthest from the paper support base after lamination. The total caliper of the laminated substrate was 220.36 μm.

Invention Example 7

Thermal dye image receiver element Invention Example 7 was prepared as described in Comparison Example 6, except that the extruded tie layer was replaced with an extruded opacifying layer containing 5 weight % of Ti-Pure® R-104 $TiO_2$ (from DuPont) and 95 weight % of ethylene methyl acrylate copolymer (Exxon Mobil's Optema™ TC130, 20 MFR).

Invention Example 8

Thermal dye image receiver element Invention Example 8 was prepared as described above in Comparison Example 6, except that the extruded tie layer was replaced with an extruded opacifying layer containing 10 weight % of Ti-Pure® R-104 $TiO_2$ (from DuPont) and 90 weight % of ethylene methyl acrylate copolymer (Exxon Mobil's Optema™ TC130, 20 MFR).

Invention Example 9

Thermal dye image receiver element Invention Example 9 was prepared as described above in Comparison Example 6, except that the extruded tie layer was replaced with an extruded opacifying layer containing 10 weight % zinc sulfide and 90 weight % ethylene methyl acrylate copolymer (Exxon Mobil's Optema™ TC130, 20 MFR).

Comparison Example 10

Thermal dye image receiver element Comparison Example 10 was prepared by laminating a three-layer biaxially-oriented voided polypropylene film (350K18, ExxonMobil Chemical, Macedon, N.Y.) of caliper 33.02 μm to one side of a paper support base of caliper 132.08 μm to form the face side of a laminated substrate. A mixture of high and low density polyethylene was used to adhere the film to the paper support base. To balance the curl of the laminated substrate, a biaxially-oriented polypropylene film (70MLT, ExxonMobil Chemical, Macedon, N.Y.) of caliper 17.78 μm was laminated to the back side of the paper support base using a mixture of high and low density polyethylene as a laminating tie layer. The total caliper of this laminated support was 213.36 μm.

A subbing layer of 50 weight % of Neorez R600 and 50 weight % of acicular tin oxide FS 10D was applied to the face side of the laminated substrate at a targeted dry coverage of 60 $mg/ft^2$ (646 $mg/m^2$). The aqueous coating solution for applying the aqueous subbing layer was 5% solids. The thermal dye receiver layer (DRL) used in Comparison Example 1 was subsequently extrusion coated at 2 μm thickness to the aqueous subbing layer coated substrate.

Neorez R 600 was an aqueous dispersion of polyurethane latex ($T_g$ of −32° C.) as supplied by DSM Neoresins at 30% solids.

FS 10D was an aqueous dispersion of antimony-doped conductive tin oxide supplied by Ishihara Corporation at 20% solids.

Comparison Example 11

Thermal dye image receiver element Comparison Example 11 was prepared as described in Comparison Example 10, except that a six-layer biaxially-oriented voided metalized polypropylene film from Vibac (40PZN), previously described in Comparison Example 6. The metalized layer was farthest from the paper support base after lamination. The total caliper of the laminated substrate was 220.36 μm.

Invention Example 12

Thermal dye image receiver element Invention Example 12 was prepared as described above in Comparison Example 11, except that an opacifying layer of 85 weight % of Neorez R600 and 15 weight % of $TiO_2$ was applied to the face side of the laminated substrate at a targeted dry coverage of 60 $mg/ft^2$ (648 $mg/m^2$). The $TiO_2$ used in this example was Ti-Pure® RPS Vantage, an aqueous dispersion of rutile $TiO_2$ supplied by DuPont at 71.5% solids.

Invention Example 13

Thermal dye image receiver element Invention Example 13 was prepared as described above in Comparison Example 11, except that an opacifying layer of 75 weight % of Neorez R600 and 25 weight % of $TiO_2$ was applied to the face side of the laminated support at a targeted dry coverage of 60 $mg/ft^2$ (646 $mg/m^2$).

Comparison Example 14

Thermal dye image receiver element Comparison Example 14 was prepared as described above in Comparison Example 11, except that an aqueous subbing layer of 100 weight % of Neorez R600 was applied to the face side of the laminated support at a targeted dry coverage of 60 $mg/ft^2$ (648 $mg/m^2$).

Invention Example 15

Thermal dye image receiver element Invention Example 15 was prepared as described above in Comparison Example 5 except that the extruded tie layer was replaced with an extruded opacifying layer containing 5 weight % of Ti-Pure R-104 $TiO_2$ (from DuPont). and 95 weight % of ethylene methyl acrylate copolymer (Exxon Mobil's Optema™ TC130, 20 MFR).

Invention Example 16

Thermal dye image receiver element Invention Example 16 was prepared as described above for Comparison Example 5 except that the extruded tie layer was replaced with an extruded opacifying layer containing 10 weight % of Ti-Pure R-104 $TiO_2$ (from DuPont). and 90 weight % of ethylene methyl acrylate copolymer (Exxon Mobil's Optema™ TC130, 20 MFR).

Testing:

Specular Reflection:

The specular reflection of unprinted substrate samples and of printed thermal dye image receiver elements was characterized using Filmetrics F-20 reflectometer. Specular reflection was determined across the entire visible spectrum, but a representative wavelength at which specular reflectance is reported here is 550.65 nm.

Surface Electrical Resistance (SER):

The surface electrical resistance (SER) of thermal dye image receiver elements was measured with a Trek Surface Resistance meter Model 152P-CR using concentric ring electrodes, following ANSI/ESD STM 11.11 standard.

Printing:

Printing was carried out on a Kodak® 6800 thermal printer whose print line time is around 1 milli-second. A thermal donor ribbon was placed into direct contact with the thermal dye image receiver elements during printing. Dye images of varying color and density were printed, particularly metal colors such as copper, silver, and gold. $D_{min}$ prints were also made (no dye image was printed, but a protective overcoat was applied). Inspection of the images for uniformity were made, specifically for "print drop-out", evidence that the donor element and receiver element were not sufficiently in contact to effect complete dye transfer, if any, on a pixel by pixel basis.

Optical Density:

Optical density was characterized using a Gretag-Macbeth Spectroscan.

Gloss:

Gloss was characterized at 20° on the printed $D_{min}$ supports using a BYK Gardner micro-Tri-gloss meter.

Light Stability:

Print samples were exposed to 50 Klux high intensity daylight for 28 days. Prints were measured for optical density before and after exposure. Interpolated results from starting densities of 1.5 and 1.0 are reported.

Results:

Referring to TABLE I below, Comparison Example 1 provided standard photographic images with good density and white $D_{min}$, but it did not provide true metallic appearance with metal colors.

Comparison Example 2 provided similar results to Comparison Example 1, except that the lack of $TiO_2$ scattering centers provided an image with a pearlescent appearance and somewhat less detail in the $D_{min}$ areas of the print. The metal colors were somewhat more "metallic appearing", but the angular and image dependence of the appearance of the images was unsatisfactory.

Comparison Example 3 provided images with "metallic luster", but the $D_{min}$ density was high, resulting in unacceptable whites and highlights in the images. The lack of a voided layer in the compliant film resulted in an unacceptable amount of print drop out.

Comparison Examples 4, 5, and 6 each had a voided compliant layer and metalized layer that provides images with "metallic luster", but the $D_{min}$ density was high, resulting in unacceptable whites and highlights in the image. The presence of a voided layer in the compliant film resulted in no print drop out. The specular reflectance of the substrate was reduced when coated with non-opacifying extruded tie layer and dye receiver layer, but this reduction was insufficient to provide acceptable $D_{min}$ due to the lack of actual reflective, scattering sites below the dye image.

Invention Examples 7, 8, 9, 15, and 16 were thermal dye image receivers of the present invention that had a substrate with a support base of paper, a voided compliant layer with a metalized layer, and an opacifying layer with a dye receiver layer disposed over the opacifying layer. These receiver elements provided images that were uniform with no drop out, had white appearing $D_{min}$, and non-image dependent metallic appearance, especially for metal colors. The images also exhibited high gloss. The presence of the opacifying agents in the opacifying layer provided sufficient light scattering to improve the $D_{min}$, but not enough to eliminate the benefit of the metallic appearance afforded by the metalized layer located underneath the opacifying layer.

Furthermore, use of a metalized laminate showed that there was no need of a tie layer that was antistatic, since the metal coating on the compliant layer film that was adhered to the paper base support was very conductive. Due to the high conductivity of the metalized compliant layer, unprinted thermal receivers of the present invention were antistatic and had a low propensity to develop charge and collect dust.

TABLE I below also shows comparisons of the effect of addition of scattering agents in the extruded tie layer on the visual appearance, % specular reflectance, and surface electrical resistivity (SER) of thermal dye image receiver elements created using metalized and voided laminate. It was observed that the addition of scattering agents like $TiO_2$ and ZnS at the levels described did not affect the metallic luster. Furthermore, the addition of these inorganic particles caused improvement in $D_{min}$. It was also observed that the addition of these inorganic particles maintained the unprinted receiver surface electrical resistivity (SER) in the antistatic regime.

TABLE II below summarizes HID (high intensity day light) dye fade test data. It was observed after 28 days of exposure to HID conditions (@50 Klux) that the extent of dye fade of inventive thermal dye receiver elements having metalized layers and opacifying layers was less than that for Comparison Example 1 (without the metalized or opacifying layers). Provided in TABLE IV are the green channel (magenta dye) and the blue channel (yellow dye) density data of red color patches from their baseline optical density of 1.5 and 1.0. The reported data represent the differences of the final density minus the starting density.

Comparison Examples 5 and 6 exhibited less density change after exposure to 50 Klux high density daylight for 28 days than Comparison Example 1. Invention Examples 7 and 8 having 5 weight % and 10 weight % of $TiO_2$, respectively, also exhibited improved light stability, although to a lesser extent than Comparison Example 6 having the same compliant layer and metalized layer.

Referring to TABLE III below, Comparison Example 10 was similar in construction and performance to Comparison Example 1, except that an aqueous antistatic subbing layer was applied to the compliant layer instead of an extruded tie layer. Comparison Examples 11 and 14 having a metalized layer over the compliant layer demonstrated printed images with metallic appearance, but they also exhibited high $D_{min}$, due to the lack of opacifying agents in the subbing layer. Invention Examples 12 and 13 having opacifying layers according to the present invention provided images with metallic appearance, white appearing $D_{min}$, and high gloss. The resulting printed images from Invention Examples 12 and 13 were distinctive and provided a visual appeal when compared to Comparison Examples 10, 11, and 14.

To determine the effectiveness of copy protection of the inventive thermal dye receiver elements, original printed images of each thermal dye image receiver were scanned, and then the scanned images were reprinted on a 1 millisec line time thermal printer. Referring to TABLE IV below, it was observed that Invention Example 12 and Comparison Example 14 were more difficult to copy in photocopiers or scanners than Comparison Example 10. The re-printed image from the scan of Comparison Example 10 was reproduced well and therefore Comparison Example 10 did not provide copy protection. The re-printed images from Invention Example 12 and Comparison Example 14 were grainy with poor resolution, especially for Comparison Example 14. However, Invention Example 12 is a thermal dye receiver element that provided a pleasing image that was difficult to reproduce through copying and scanning systems.

TABLE I

| Thermal Dye Image Receiver Element | Compliant Layer | Opacifying Layer | Printed Visual Appearance | Printed $D_{min}$ Visual Assessment | Print drop out? | Unprinted receiver surface electrical resistivity (log ohms/square) | Receiver % Specular Reflectance @ 550.65 nm |
|---|---|---|---|---|---|---|---|
| Comparison Example 1 | ExxonMobil 350K18 (white voided) | Non-opacifying extruded tie layer | No metallic luster, traditional photographic image | White, low density, good highlight detail. | No | Out of range (on high side), insulative | <4 |
| Comparison Example 2 | Vibac 35PC (pearlescent) | Non-opacifying extruded tie layer | Nacreous appearance (angular and image dependent) | Washed out; no detail | No | Out of range (on high side), insulative | Not measured |
| Comparison Example 3 | ExxonMobil 70MET (non-voided film with metalized layer) | Non-opacifying extruded tie layer | Metallic luster that was not image dependent | $D_{min}$ was high/ non-white; washed out; no detail | Yes | Not measured | Not measured |
| Comparison Example 4 | ExxonMobil 28MWHB (voided film with metalized layer) | Non-opacifying extruded tie layer | Metallic luster that was not image dependent, able to generate metallic colors like gold, silver and copper. | $D_{min}$ was high/ non-white; washed out; no detail | No | Not measured | Not measured |
| Comparison Example 5 | ExxonMobil 35MWHB (voided film with metalized layer) | Non-opacifying extruded tie layer | Metallic luster that was not image dependent, able to generate metallic colors like gold, silver and copper. | $D_{min}$ was high/ non-white; washed out; no detail | No | 11.35 (antistatic) | 50.51 |
| Comparison Example 6 | Vifan 40 PZN (voided film with metalized layer) | Non-opacifying extruded tie layer | Metallic luster that was not image dependent, able to generate metallic colors like gold, silver and copper. | $D_{min}$ was high/non-white; washed out; no detail | No | 10.95 (antistatic) | 36.21 |
| Invention Example 7 | Vifan 40 PZN (voided film with metalized layer) | 5 weight % $TiO_2$ in extruded tie layer | Metallic luster that was not image dependent, able to generate metallic colors like gold, silver and copper. | Improved $D_{min}$; $D_{min}$ was reduced by 50%. | No | 11.07 (antistatic) | 20.81 |
| Invention Example 8 | Vifan 40 PZN (voided film with metalized layer) | 10 weight % $TiO_2$ in extruded tie layer | Metallic luster that was not image dependent, able to generate metallic colors like gold, silver and copper. | Improved $D_{min}$; $D_{min}$ was reduced by 50%. | No | 11.51 (antistatic) | 12.99 |
| Invention Example 9 | Vifan 40 PZN (voided film with metalized layer) | 10 weight % ZnS in extruded tie layer | Metallic luster that was not image dependent, able to generate metallic colors like gold, silver and copper. | Improved $D_{min}$ | No | Not measured | 49.27 |

TABLE I-continued

| Thermal Dye Image Receiver Element | Compliant Layer | Opacifying Layer | Printed Visual Appearance | Printed $D_{min}$ Visual Assessment | Print drop out? | Unprinted receiver surface electrical resistivity (log ohms/square) | Receiver % Specular Reflectance @ 550.65 nm |
|---|---|---|---|---|---|---|---|
| Invention Example 15 | ExxonMobil 35MWHB (voided film with metalized layer) | 5 weight % $TiO_2$ in extruded tie layer | Metallic luster that was not image dependent; able to generate metallic colors like gold, silver, and copper | Improved $D_{min}$ | No | Not measured | 29.8 |
| Invention Example 16 | ExxonMobil 35MWHB (voided film with metalized layer) | 10 weight % $TiO_2$ in extruded tie layer | Metallic luster that was not image dependent; able to generate metallic colors like gold, silver, and copper | Improved $D_{min}$ | No | Not measured | 19.22 |

TABLE II

| Image stability represented by dye fade | | | | | | |
|---|---|---|---|---|---|---|
| Thermal Dye Image Receiver Element | Compliant Layer | Opacifying Layer | Green of Red (for density 1.5) - change in density | Blue of Red (for density 1.5) - change in density | Green of Red (for density 1.0) - change in density | Blue of Red (for density 1.0) - change in density |
| Comparison Example 1 | ExxonMobil 350K18 (white voided) | Non-opacifying extruded tie layer | −0.87 | −0.86 | −0.49 | −0.55 |
| Comparison Example 5 | ExxonMobil 35MWHB (voided film with metalized layer) | Non-opacifying extruded tie layer | −0.59 | −0.645 | −0.205 | −0.29 |
| Comparison Example 6 | Vifan 40 PZN (voided film with metalized layer) | Non-opacifying extruded tie layer | −0.585 | −0.62 | −0.205 | −0.28 |
| Invention Example 7 | Vifan 40 PZN (voided film with metalized layer) | 5 weight % $TiO_2$ in extruded tie layer | −0.67 | −0.665 | −0.295 | −0.34 |
| Invention Example 8 | Vifan 40 PZN (voided film with metalized layer) | 10 weight % $TiO_2$ in extruded tie layer | −0.8 | −0.78 | −0.385 | −0.43 |

TABLE III

| Thermal Dye Image Receiver Element | Compliant Layer | Opacifying Layer | Visual Appearance | Printed Dmin Visual Assessment | Dmin 20° Gloss | Receiver % Specular reflectance at 550.65 nm |
|---|---|---|---|---|---|---|
| Comparison Example 10 | ExxonMobil 350K18 (white voided) | Non-opacifying conductive aqueous subbing layer | No metallic luster, traditional photographic image | White, low density, good highlight detail. | 49.5 | 5.4 |
| Comparison Example 11 | Vifan 40 PZN (voided film with metalized layer) | Non-opacifying conductive aqueous subbing layer | Metallic luster that was not image dependent; able to generate metallic colors like gold, silver and copper. | $D_{min}$ was high/ non-white; washed out; no detail | 161.9 | 44.8 |
| Invention Example 12 | Vifan 40 PZN (voided film with metalized layer) | Opacifying non-conductive aqueous subbing layer | Metallic luster that was not image dependent; able to generate metallic colors like gold, silver and copper. | Improved $D_{min}$; $D_{min}$ was reduced by 50%. | 93.1 | 31.21 |
| Invention Example 13 | Vifan 40 PZN (voided film with metalized layer) | Opacifying non-conductive aqueous subbing layer | Metallic luster that was not image dependent, able to generate metallic colors like gold, silver and copper. | Improved $D_{min}$; $D_{min}$ was reduced by 50%. | 79.6 | 22.99 |

TABLE III-continued

| Thermal Dye Image Receiver Element | Compliant Layer | Opacifying Layer | Visual Appearance | Printed Dmin Visual Assessment | Dmin 20° Gloss | Receiver % Specular reflectance at 550.65 nm |
|---|---|---|---|---|---|---|
| Comparison Example 14 | Vifan 40 PZN (voided film with metalized layer) | Non-opacifying non-conductive aqueous subbing layer | Metallic luster that was not image dependent, able to generate metallic colors like gold, silver and copper | $D_{min}$ was high; non-white; washed out; no detail | Not measured | Not measured |

TABLE IV

| Thermal Dye Image Receiver Element | Compliant Layer | Opacifying Layer | Copy Protection |
|---|---|---|---|
| Comparison Example 10 | ExxonMobil 350K18 (white voided) | Non-opacifying conductive aqueous subbing layer | Easy to scan and copy, good resolution; reprinted image from scanned file resulted in a high quality image |
| Invention Example 12 | Vifan 40 PZN (voided film with metalized layer) | Opacifying non-conductive aqueous subbing layer | Slightly difficult to scan and copy, resolution lower; reprinted image from scanned file resulted in some image color alteration |
| Comparison Example 14 | Vifan 40 PZN (voided film with metalized layer) | Non-opacifying non-conductive aqueous subbing layer | Difficult to scan and copy, resolution lower; reprinted image from scanned file resulted in a dark and grainy image |

Comparison Example 20

A duplex thermal dye image receiver element was prepared as described above in Comparison Example 10 except that the back side had the same layers as the front side in order from the paper support base: a polyethylene tie layer, the 350K18 face-side film, an aqueous subbing layer of 50 weight % Neorez R600 and 50 weight % acicular tin oxide FS 10D at a targeted dry coverage of 60 mg/ft$^2$ (648 mg/m$^2$), and 2 μm thick dye-receiving layer.

Invention Example 21

A duplex thermal dye image receiver element was prepared as described above for Invention Example 12 except that the back side had the same layers as the front side in order from the paper support base: a polyethylene tie layer, the 40 PZN face-side film, an opacifying layer of 85 weight % Neorez R600 and 15 weight % $TiO_2$ (coated at 30% solids) at a targeted coverage of 60 mg/ft$^2$ (648 mg/m$^2$), and a 2 μm thick dye-receiving layer in that order from the back side of the paper support base.

Comparison Example 20 and Invention Example 21 were printed in a Kodak® D4000 duplex thermal printer. The images printed for Invention Example 21 displayed a metallic appearance with a white appearing $D_{min}$ and good detail in highlight portions of the images with a visual appeal, distinct from the images printed from Comparison Example 20.

Invention Example 22

A duplex thermal dye image receiver element was prepared as described above for Invention Example 12 except that the back side had the same layers as described for Comparison Example 10, specifically the polyethylene layer, the three-layer biaxially-oriented voided polypropylene film (350K18, ExxonMobil Chemical, Macedon, N.Y.), the aqueous subbing layer, and the 2 μm thick dye-receiving layer in that order from the back side of the paper support base.

Comparison Example 20 and Invention Examples 21 and 22 were printed in a Kodak D4000 duplex thermal printer. The images printed on both sides of Invention Example 21 displayed a metallic appearance with a white appearing $D_{min}$, and good detail in highlight portions of the images with a visual appeal, distinct from the imaged printed from Comparison Example 20. The images printed on the side of Invention Example 22 with the metalized layer and the opacifying layer of the invention displayed a metallic appearance with a white appearing $D_{min}$ and good detail in highlight portions of the images, in contrast to the reverse side images which were of a typical photographic quality and $D_{min}$. This duplex thermal dye image receiver element of the invention was particularly suited for greeting cards and invitations with visually appealing metallic colors on one side and text and photo information on the other side.

The invention has been described in detail with particular reference to certain preferred embodiments thereof, but it will be understood that variations and modifications can be effected within the spirit and scope of the invention.

The invention claimed is:

1. A thermal dye image receiver element comprising, in order:

a substrate comprising the following layers in order:

a voided compliant layer, and a metalized layer;

an opacifying layer, and a dye receiving layer, wherein the opacifying layer comprises an opacifying agent in an amount sufficient to provide the thermal dye image receiver element with a reflectance of at least 10% and up to and including 50%.

2. The thermal dye image receiver element of claim 1, wherein the substrate comprises the following layers in order:

a support base, the voided compliant layer, and the metalized layer.

3. The thermal dye image receiver element of claim 1, wherein the metalized layer has a dry thickness of at least 300 Å and up to and including 1000 Å.

4. The thermal dye image receiver element of claim 1, wherein the metalized layer has a dry thickness of at least 300 Å and up to and including 600 Å.

5. The thermal dye image receiver element of claim 1, wherein the opacifying layer comprises an opacifying agent that is selected from the group consisting of titanium dioxide, barium sulfate, calcium carbonate, zinc sulfide, and mixtures thereof.

6. The thermal dye image receiver element of claim 1, wherein the opacifying layer comprises one or more opacifying agents in a total amount of at least 5 $mg/m^2$ and up to and including 20 $mg/m^2$.

7. The thermal dye image receiver element of claim 1, wherein the ratio of the dry thickness of the metalized layer to the dry thickness of the dye receiving layer is at least 0.005:1 and up to and including 0.05:1.

8. The thermal dye image receiver element of claim 1, wherein the thermal dye image receiver element is a duplex thermal dye image receiver element comprising, on both sides of the substrate, a same or different voided compliant layer, a same or different metalized layer, a same or different opacifying layer, and a same or different dye receiving layer.

9. The thermal dye image receiver element of claim 8, wherein the duplex thermal dye image receiver element comprises the same voided compliant layer, metalized layer, opacifying layer, and dye receiving layer on both sides of the substrate.

10. The thermal dye image receiver element of claim 1, wherein the thermal dye image receiver element is a duplex thermal dye image receiver element comprising the following layers in order on a first side of a support base: a voided compliant layer, a metalized layer, an opacifying layer, and a dye receiving layer, and comprising on a second side of the support base, in order, a same or different voided compliant layer, and a same or different dye receiving layer.

11. The thermal dye image receiver element of claim 1 further comprising a polymeric skin layer directly adjacent to one or both sides of the voided compliant layer, wherein each of the polymeric skin layers optionally contains titanium dioxide.

12. The thermal dye image receiver element of claim 1, wherein the metalized layer comprises aluminum.

13. The thermal dye image receiver element of claim 1 wherein the substrate comprises a raw paper base, a voided compliant layer that comprises uni- or bi-axially oriented polypropylene, uni- or bi-axially oriented poly (ethylene terephthalate), foamed polypropylene, or foamed poly(ethylene terephthalate), a polymeric skin layer directly on either or both sides of the voided compliant layer, and an aluminum metalized layer.

14. The thermal dye image receiver element of claim 1, wherein:

the substrate comprises, in order:

a raw paper support base, an adhesive layer, a voided compliant layer, a polymeric skin layer directly adjacent to at least one side of the compliant layer, wherein the polymeric skin layer optionally comprises titanium dioxide, and an aluminum metalized layer having a dry thickness of at least 300 Å and up to and including 600 Å, the opacifying layer comprises one or more opacifying agents including at least titanium dioxide in a total amount of at least 5 $mg/m^2$ and up to and including 20 $mg/m^2$, wherein the opacifying layer provides a reflectance of at least 10% and up to and including 35%.

15. The thermal dye image receiver element of claim 14 wherein the thermal dye image receiver element is a duplex thermal dye image receiver element comprising the same layer arrangement and composition on both sides of the raw paper support base.

16. An assembly comprising the thermal dye image transfer receiver element of claim 1 in thermal association with a thermal donor element.

17. A method of thermal dye transfer printing comprising thermally imaging the thermal dye image receiver element of claim 1 by thermally associating the dye image receiver element with a thermal donor element to provide a thermal dye image, a protective laminate, or both, in the thermal dye image receiver element.

18. The method of claim 17, wherein the thermal dye image receiver element is a duplex element, and the method comprises thermally imaging one or both sides of the thermal dye image receiver element by thermally associating the dye image receiving element with one or more thermal donor elements to provide a same or different thermal dye image, protective laminate, or both, independently to the one or both sides of the thermal dye image receiver element.

19. The method of claim 17, wherein:

the substrate comprises, in order:

a raw paper support base, an adhesive layer, a voided compliant layer, a polymeric skin layer directly adjacent to at least one side of the compliant layer, wherein the polymeric skin layer optionally comprises titanium dioxide, and an aluminum metalized layer having a dry thickness of at least 300 Å and up to and including 600 Å, and wherein the opacifying layer comprises one or more opacifying agents including at least titanium dioxide in a total amount of at least 5 $mg/m^2$ and up to and including 20 $mg/m^2$ to provide a reflectance of at least 10% and up to and including 35%.

* * * * *